US005799815A

United States Patent [19]

Lang

[11] Patent Number: 5,799,815

[45] Date of Patent: Sep. 1, 1998

[54] DEVICE AND KIT FOR IDENTIFYING POP-TOP CANS

[75] Inventor: Michael A. Lang, Castaic, Calif.

[73] Assignees: Tony David; Gregory A. Gile, both of Santa Clarita, Calif.

[21] Appl. No.: 755,676

[22] Filed: Nov. 25, 1996

[51] Int. Cl.[6] ..... B65D 51/22

[52] U.S. Cl. ..... 220/258; 220/259; 220/269; 220/906; 206/459.5; 206/576; 150/154; 40/307

[58] Field of Search ..... 220/258, 259, 220/269, 703, 729, 906, 212.5; 215/230; 206/223, 459.5, 576; 150/154, 155, 161, 165; 40/306, 307, 634; 81/3.55

[56] References Cited

U.S. PATENT DOCUMENTS

| | | | |
|---|---|---|---|
| 2,207,269 | 7/1940 | Schiff | 150/161 X |
| 2,968,300 | 1/1961 | Allen | 150/154 |
| 2,976,629 | 3/1961 | Brixius . | |
| 3,110,336 | 11/1963 | Sukala, Jr. | 150/154 |
| 3,354,564 | 11/1967 | Falcone . | |
| 3,772,809 | 11/1973 | Schneller . | |
| 3,787,993 | 1/1974 | Lyon . | |
| 3,822,496 | 7/1974 | Minder | 220/906 X |
| 3,930,592 | 1/1976 | DiIanni . | |
| 3,958,354 | 5/1976 | Hough et al. . | |
| 3,974,916 | 8/1976 | Bartolucci . | |
| 4,214,389 | 7/1980 | Fitzgerald . | |
| 4,271,616 | 6/1981 | Boykin . | |
| 4,325,230 | 4/1982 | Driscoll et al. . | |
| 4,363,179 | 12/1982 | Ruemer, Jr. . | |
| 4,391,167 | 7/1983 | Bergmeister | 81/3.55 X |
| 4,537,326 | 8/1985 | Morehead | 220/269 |
| 4,660,446 | 4/1987 | Soltis | 81/3.55 |
| 4,681,358 | 7/1987 | Smith | 294/15 |
| 4,713,900 | 12/1987 | Calloway, Jr. . | |
| 4,899,474 | 2/1990 | Plana et al. . | |
| 4,941,573 | 7/1990 | Fuerstman . | |
| 5,191,979 | 3/1993 | Nemeroff . | |
| 5,261,176 | 11/1993 | David et al. . | |
| 5,301,802 | 4/1994 | Nemeroff . | |
| 5,316,166 | 5/1994 | Pavely et al. | 220/269 |
| 5,339,549 | 8/1994 | David et al. . | |
| 5,358,770 | 10/1994 | Evans . | |
| 5,492,077 | 2/1996 | Rose . | |

FOREIGN PATENT DOCUMENTS

| | | |
|---|---|---|
| 3599362 | 8/1971 | Germany . |

*Primary Examiner*—Stephen Cronin
*Attorney, Agent, or Firm*—John J. Posta, Jr.

[57] ABSTRACT

An improved device for identifying an individual pop-top can having a pull tab for levering open the can is provided. The device includes a flexible resilient sleeve of elastomeric plastic or rubber or the like which slides over and seats on the free end of the pop-top can tab. The sleeve has a distinctive color, design, texture, written indicia or any combination thereof, in order to identify the individual can. A kit is also provided which includes a number of the sleeves, all of which differ from each other in color, texture, written indicia and/or design. One embodiment of the sleeve includes an integral plug which extends upwardly from the top of the sleeve and is shaped and dimensioned to plug the can opening to preserve the contents thereof after opening. The sleeve is simple, inexpensive and attractive and enables users of similar cans to identify their own cans and thus not drink from another user's can.

9 Claims, 1 Drawing Sheet

FIG. 1
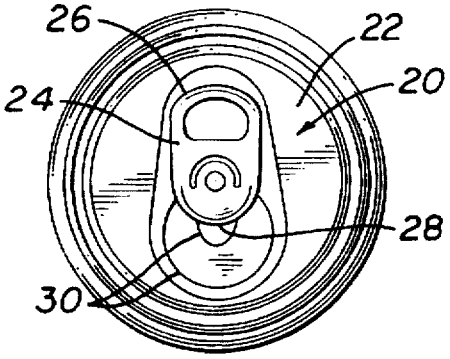
FIG. 2
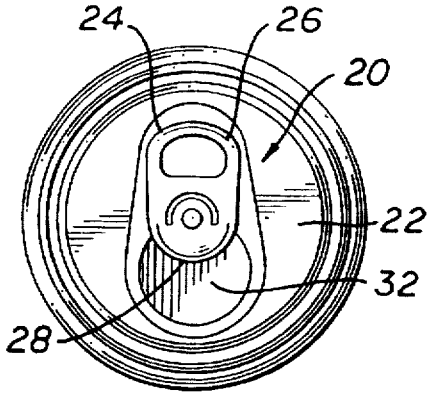
FIG. 7
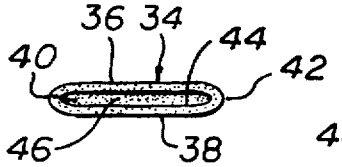
FIG. 8
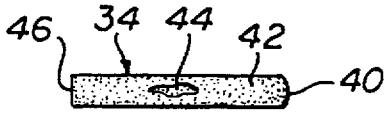
FIG. 3
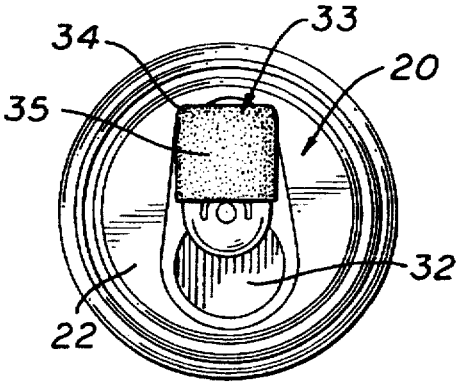
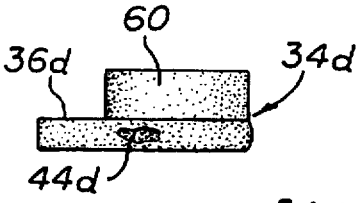
FIG. 9
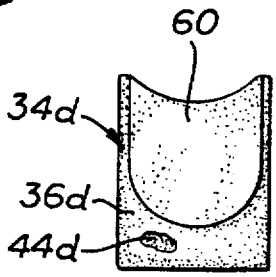
FIG. 10
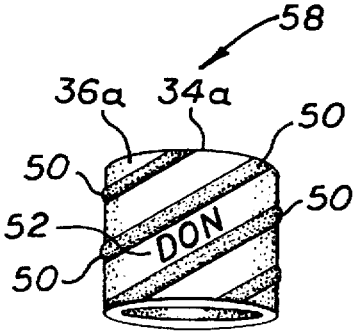
FIG. 4
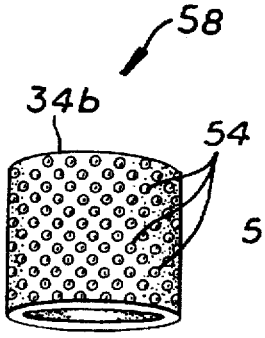
FIG. 5
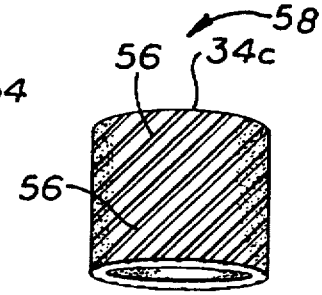
FIG. 6

DEVICE AND KIT FOR IDENTIFYING POP-TOP CANS

BACKGROUND OF THE INVENTION

1. Field of the Invention

The present invention generally relates to identifying means and more particularly to an improved device and kit for identifying individual pop-top cans.

2. Prior Art

Modern medicine and most informed people generally recognize the desireability of not drinking from another person's beverage can. This is particularly important because of the widespread presence of germs and other contagion, including AIDS, Hepatitis A, B, C, G and the like, cold sores (Herpes) flue viruses, etc.

It is a frequent practice for persons using pop-top beverage cans to drink directly from the can rather than pouring the can contents into a glass. If another person mistakenly then drinks from the same can, contagious disease can be transmitted through the act of such drinking. Accordingly, there is a need for a simple, inexpensive, easy to use device for marking individual pop-top cans to prevent such inadvertent drinking from the wrong can, particularly where a number of individuals are all using cans having the same general appearance.

There is also a need to provide such an identifying device which will prevent squabbles between siblings and friends about whose can is whose.

It would also be desireable to be able to provide the can-identifying device with means for plugging the can opening when not all the can contents are used immediately. This is especially the case when carbonated soft drinks are in the cans. If the can is left standing open any great length of time, the carbonation disappears, the drink becomes "flat" and the drink must then be thrown away. Such a can-identifying device, with or without the sealing plug, should be simple to use, inexpensive, durable and reuseable. It should be capable of being washed or sterilized for reuse.

SUMMARY OF THE PRESENT INVENTION

The improved device for identifying individual pop-top cans satisfies all the foregoing needs. The device is simple, easy to make and use, durable and reuseable. It may include a plug for resealing an opened pop-top can to preserve its contents.

The device comprises a hollow sleeve, preferably generally rectangular in shape and containing a central longitudinal passageway dimensioned such that the sleeve can be slipped over the pull tab of a pop-top can and will seat thereon and hold its position on the tab, even if the can is tilted. Preferably, one end of the sleeve is closed and the opposite end is open to the passageway. The sleeve is constructed of elastomeric, flexible, resilient material such as plastic or rubber and dimensioned to slide over but to fit closely around the free end of the pull tab.

The sleeve includes means for readily identifying the particular sleeve and thus the particular can to which it can be connected. Such identifying means comprises a distinctive color, texture, design and/or written indicia on the top of the sleeve. In one embodiment a plurality of the sleeves are provided in a kit, wherein each sleeve differs all other sleeves in the kit in one or more of the above-listed identifying aspects.

The sleeve is inserted on the free end of the pull tab before or after the tab is lifted to open the pop-top can, and when so inserted on the tab renders that particular can distinctive and readily identifiable, so that mistaken drinking by the wrong person from a can so marked will not occur.

In one embodiment the top of the sleeve has an upraised integral plug shaped and dimensioned to plug shut the opening in an open pop-top can to preserve its contents, particularly when those contents are carbonated beverage. In order to use the plug, the sleeve is slid from the tab and inverted and the plug is then forced into the can opening. When in place the plug and the remainder of the sleeve still serve to identify the can.

Further features of the improved can-identifying device and kit of the present invention are set forth in the following detailed description and accompanying drawings.

DRAWINGS OF THE INVENTION

FIG. 1 is a schematic top plan view of a conventional pop-top can bearing a pull tab, the can being unopened;

FIG. 2 is a schematic top plan view of the can of FIG. 1 after it is opened by its pull tab;

FIG. 3 is a schematic top plan view of the can of FIG. 2 after a first preferred embodiment of the distinctive identifying sleeve device of the present invention is slid over and seats on the free end of the can pull tab;

FIG. 4 is a schematic top perspective view of a second preferred embodiment of the sleeve of the present invention;

FIG. 5 is a schematic top perspective view of a third preferred embodiment of the sleeve of the present invention;

FIG. 6 is a schematic top perspective view of a fourth preferred embodiment of the sleeve of the present invention, one form of the kit of the present invention being depicted collectively in FIGS. 4, 5 & 6;

FIG. 7 is a schematic front elevation of the sleeve of FIG. 3;

FIG. 8 is a schematic side elevation, partly broken away, of the sleeve of FIG. 3;

FIG. 9 is a schematic side elevation, partly broken away, of a fifth preferred embodiment of the sleeve of the present invention; and, FIG. 10 is a schematic top plan view, partly broken away, of the sleeve of FIG. 9.

DETAILED DESCRIPTION OF THE INVENTION

FIGS. 1–3, 7 and 8.

Now referring more particularly to FIGS. 1–3, 7 and 8 of the drawings, a first preferred embodiment of the improved pop-top can identifying device of the present invention is schematically depicted in FIGS. 1–3, 7 and 8 and the drawings.

In FIG. 1 a closed conventional pop-top can 20 for beverages and the like is shown, which includes a conventional metal top 22 having a pull tab 24 of conventional size and shape hinged thereto, so that when the free end 26 of tab 24 is lifted its opposite inner end 28 bears down on a scored area 30 of top 22, bending it down in order to open can 20, thus providing it with opening 32 from which to pour beverage disposed in can 20. FIG. 2 shows can 20 after such opening.

In FIG. 3, a first preferred embodiment of the improved identifying device of the present invention is shown. Thus, device 33 is shown in the form of a sleeve 34 which has been slipped over the free end 26 of tab 24 and seated thereon. In this instance, sleeve 34 is of a distinctive dark color 35 for identifying can 20 to enable the user of can 20 to easily locate can 20 among a group of otherwise similar cans and exclusively drink from can 20.

Sleeve 34 is of flexible, resilient material such as elastomeric plastic or rubber and preferably is generally rectangular and generally flat with a top 36 separated from a bottom 38 by a closed end wall 40 and opposite sides 42 to form a flattened tube defining a longitudinal tab-receiving passageway 44 extending from open end 46 of sleeve 34 opposite closed end wall 40.

Sleeve 34 can be slipped easily over the free end 26 of tab 24 and just as easily removed therefrom when can 20 is empty, so that sleeve 34 can be reused. Sleeve 34 is dimensioned to slip over free end 26 of tab 24 but remain seated thereon without falling off when can 20 is raised to drink therefrom. Accordingly, sleeve 34 forms an effective can-identifying device in accordance with-the present invention. Sleeve 34 can be formed inexpensively in a simple molding operation and is durable enough to be washed, sterilized by heating, etc., for reuse.

FIGS. 4, 5 and 6.

FIGS. 4, 5 and 6 schematically depict three sleeves, each of which is distinctive and each of which can be substituted for sleeve 34. Thus, sleeve **34*a* (FIG. 4), sleeve 34*b* (FIG. 5) and sleeve 34*c* (FIG. 6) are shown. Sleeves 34*a*, 34*b* and 34*c* are substantially identical to sleeve 34, differing from sleeve 34** and from each other only in the manner in which they are visually and/or tactily distinguishable from each other.

Thus, sleeve **34*a* has raised parallel diagonal ridges 50 of a distinctive color on the top 36*a* thereof for easy identification by sight and feel. In addition, it bears written indicia 52 on top 36*a*** in the form of a printed name "DON" for such identification purposes.

Sleeve **34*b* has a plurality of spaced raised pimples 54 on top 36*b* thereof for easy tactile identification of sleeve 34*b***.

Sleeve **34*c* has on top 36*c* thereof colored spaced grooves 56** for both visual and tactile identification.

Sleeves **34*a*, 34*b* and 34*c* can be used to form kit 58 of the present invention, which kit 58 comprises a plurality of such sleeves 34*a*, 34*b* and 34*c* or the like wherein each such sleeve differs from the remaining sleeves in design, color, texture and/or written indicia. It will be understood that, if desired, kit 58 can comprise a plurality of sleeves 34, which sleeves 34 differ in kit 58** only in color from each other.

FIGS. 9 and 10.

Another embodiment of the improved identifying device of the present invention is schematically set forth in FIGS. 9 and 10. Thus, device 33d is depicted in FIGS. 9 and 10 and comprises a sleeve **34*d* substantially identical to sleeve 34 and containing central passageway 44*d* therein. Sleeve 34*d* differs from sleeve 34 only in that top 36*d* has an upraised integral plug 60 projecting upwardly therefrom and shaped and dimensioned for releasably wedging into opening 32 of can 20 to seal the same and preserve the contents thereof. Plug 60 can be formed together with the remainder of sleeve 34*d*** in a single molding operation and is of the same elastomeric material.

When it is desired to use plug 60, sleeve **34*d* is removed from tab 24 and is inverted and then plug 60 is wedged down into opening 32. In this position, plug 60 seals can 20 but also serves to distinguish can 20 from similar cans 20**.

Further features of the improved device and kit of the present invention are as set forth in the foregoing. Various other modifications, changes, alterations and additions can be made to the improved device and kit of the present invention. All such modifications, changes, alterations and additions as are within the scope of the appended claims form part of the present invention.

What is claimed is:

1. An improved device for identifying an individual pop-top can having a tab for levering open said can, said device comprising a flexible resilient sleeve which slides over and seats on the free end of a tab for opening a pop-top can, said sleeve having indicia to individually identify said sleeve, said sleeve having a top and a bottom interconnected by opposite sides, wherein said sleeve has at least one of the following identifying indicia: color, texture, written indicia and design, wherein said sleeve has an integral plug extending upwardly from the top thereof and dimensioned to plug the opening in an open pop-top can when said sleeve is removed from said tab and inverted.

2. An improved pop-top can-identifying kit, said kit comprising a plurality of flexible resilient sleeves dimensioned to slide over and seat on the free ends of tabs for opening pop-top cans, each said sleeve having indicia which identifies said sleeve from the other sleeves in said kit, each said sleeve having a top and a bottom interconnected by opposite sides.

3. The improved kit of claim 2 wherein each said sleeve has a different color on the top thereof.

4. The improved kit of claim 2 wherein each said sleeve has a different design on the top thereof.

5. The improved kit of claim 2 wherein each said sleeve has a different texture on the top thereof.

6. The improved kit of claim 2 wherein each said sleeve has a different written indicia on the top thereof.

7. The improved kit of claim 2 wherein said sleeve is distinguishable from each other sleeve in said kit by at least one of the following indicia: color, texture, written indicia and design.

8. The improved kit of claim 7 wherein each said sleeve comprises a generally rectangular, generally flat elongated tube having an open end and an opposite end, and a tab-receiving internal passageway extending longitudinally of said sleeve and communicating with said open end.

9. The improved kit of claim 7 wherein each said sleeve has an integral plug extending upwardly from the top thereof and dimensioned to plug the opening in an open pop-top can when said sleeve is removed from said tab and inverted.

* * * * *